US010227716B2

(12) United States Patent
de Vries

(10) Patent No.: US 10,227,716 B2
(45) Date of Patent: Mar. 12, 2019

(54) ARTIFICIAL TURF MAT AND METHOD FOR MANUFACTURING THEREOF

(71) Applicant: Greenfields B.V., Genemuiden (NL)

(72) Inventor: Hugo de Vries, Ridderkerk (NL)

(73) Assignee: Greenfields B.V., Nijverdal (NL)

( * ) Notice: Subject to any disclaimer, the term of this patent is extended or adjusted under 35 U.S.C. 154(b) by 200 days.

(21) Appl. No.: 15/428,179

(22) Filed: Feb. 9, 2017

(65) Prior Publication Data

US 2017/0211212 A1 Jul. 27, 2017

Related U.S. Application Data

(63) Continuation of application No. 12/801,614, filed on Jun. 17, 2010.

(51) Int. Cl.

| | |
|---|---|
| ***E01C 13/08*** | (2006.01) |
| ***D03D 1/00*** | (2006.01) |
| ***D03D 27/06*** | (2006.01) |
| ***D03D 27/02*** | (2006.01) |
| ***D03D 27/12*** | (2006.01) |
| ***D05C 15/12*** | (2006.01) |
| ***D05C 17/02*** | (2006.01) |

(Continued)

(52) U.S. Cl.

CPC ..... *D03D 27/06* (2013.01); *D03D 27/02* (2013.01); *D03D 27/12* (2013.01); *D05C 15/12* (2013.01); *D05C 17/026* (2013.01); *D06N 7/0065* (2013.01); *E01C 13/08* (2013.01); *D03D 27/04* (2013.01); *D10B 2403/0111* (2013.01); *D10B 2505/18* (2013.01); *Y10T 428/23921* (2015.04); *Y10T 428/23929* (2015.04); *Y10T 428/23936* (2015.04); *Y10T 428/23957* (2015.04)

(58) Field of Classification Search

CPC ..... E01C 13/08; D03D 1/00; D03D 13/008; D03D 27/06; D03D 2700/60; Y10T 428/23957; Y10T 428/23964; Y10T 428/23921; D06N 7/0065

USPC ..... 428/17, 92, 88, 89, 87; 139/391, 397, 2

See application file for complete search history.

(56) References Cited

U.S. PATENT DOCUMENTS

| | | | |
|---|---|---|---|
| 3,513,062 | A | 5/1970 | Vinicki |
| 3,940,522 | A | 2/1976 | Wessells |
| 4,356,220 | A | 10/1982 | Benedyk |

(Continued)

FOREIGN PATENT DOCUMENTS

| | | | |
|---|---|---|---|
| EP | 0678622 | A | 10/1995 |
| GB | 2357301 | A | 6/2001 |

(Continued)

*Primary Examiner* — Cheryl Juska

(74) *Attorney, Agent, or Firm* — N.V. Nederlandsch Octrooibureau; Lindsey A. Auerbach; Catherine A. Shultz

(57) ABSTRACT

An artificial turf mat includes a backing and a plurality of protruding artificial grass blades divided into rows and connected to the backing. The mutual distance between successive blades in a row is substantially equal to the distance between adjacent rows and is at least 10 mm. The backing and the blades may be formed and mutually connected by weaving. A method for forming an artificial turf mat includes supplying a backing material, supplying an artificial turf material, forming a backing from the backing material, and connecting blades of the artificial turf material divided into rows to the backing. The blades may be connected to the backing such that their mutual spacing in a row is substantially equal to the mutual distance between adjacent rows and is at least 10 mm.

21 Claims, 4 Drawing Sheets

(51) Int. Cl.
*D06N 7/00* (2006.01)
*D03D 27/04* (2006.01)

(56) References Cited

U.S. PATENT DOCUMENTS

| | | | |
|---|---|---|---|
| 5,601,886 | A | 2/1997 | Ishikawa et al. |
| 6,029,397 | A | 2/2000 | Motz et al. |
| 6,242,062 | B1 | 6/2001 | De Vries |
| 6,299,959 | B1 | 10/2001 | Squires et al. |
| 6,338,885 | B1 | 1/2002 | Prevost |
| 6,372,310 | B2 | 4/2002 | De Vries |
| 6,491,991 | B2 | 12/2002 | Seaton |
| 6,753,049 | B2 | 6/2004 | De Vries |
| 6,955,841 | B2 | 10/2005 | Weghuis et al. |
| 7,168,883 | B2 | 1/2007 | Waterford |
| 7,357,966 | B2 | 4/2008 | Dippie et al. |
| 7,992,595 | B2 | 8/2011 | Debaes et al. |
| 8,133,123 | B2 | 3/2012 | De Vries et al. |
| 8,491,974 | B2 | 7/2013 | De Vries |
| 2002/0028307 | A1 | 3/2002 | Prevost |
| 2003/0108688 | A1 | 6/2003 | De Vries |
| 2003/0157275 | A1 | 8/2003 | Weghuis et al. |
| 2004/0229007 | A1 | 11/2004 | Motz et al. |
| 2006/0137758 | A1 | 6/2006 | Debaes et al. |
| 2006/0204710 | A1 | 9/2006 | De Vries |
| 2007/0237921 | A1 | 10/2007 | Knapp et al. |
| 2008/0124496 | A1 | 5/2008 | Avery |
| 2009/0162578 | A1 | 6/2009 | Van Balen et al. |
| 2009/0317569 | A1 | 12/2009 | Debaes et al. |
| 2010/0092701 | A1 | 4/2010 | Debaes et al. |
| 2010/0092702 | A1 | 4/2010 | Debaes |
| 2010/0255223 | A1 | 10/2010 | De Vries |

FOREIGN PATENT DOCUMENTS

| | | | |
|---|---|---|---|
| JP | 06-042988 | U | 6/1994 |
| JP | 07-004505 | U | 1/1995 |
| JP | 09-273109 | A | 10/1997 |
| JP | 2000-027111 | A | 1/2000 |
| JP | 3086213 | U | 3/2002 |
| JP | 2002088708 | A | 3/2002 |
| JP | 2002-242120 | A | 8/2002 |
| NL | 1022214 | | 12/2002 |
| WO | 98/40559 | A | 9/1998 |
| WO | 2004057111 | A1 | 7/2004 |

ARTIFICIAL TURF MAT AND METHOD FOR MANUFACTURING THEREOF

BACKGROUND

An artificial turf mat is generally known and is used to form artificial turf fields on which for instance sports, and in particular ball sports, are played. The artificial turf fields are herein formed by laying artificial turf mats on a flat, generally slightly resilient ground and then spreading a layer of loose filling material, for instance sand or a mixture of sand and rubber granules, over these artificial turf mats. The layer of filling material herein has a thickness such that the artificial grass blades protrude thereabove, so that the artificial turf field creates the same impression as a natural grass field.

Known artificial turf mats have the drawback, however as a result of the manner in which they are manufactured, the artificial grass blades in a row stand relatively close to each other, while the mutual distance between the rows is often considerably larger. This has the consequence that an artificial turf field on the basis of such an artificial turf mat will display different properties in different directions. In ball sports, this can result in a ball not rolling uniformly over the field. Owing to this irregularity the chance of injury, for instance as a result of performing a sliding tackle, is also relatively great when such a sliding tackle is made in the direction of the rows. Tight packing of the blades in a row has the further result that the filling material is there held fast more firmly than between the rows, whereby local compaction and thereby hardening of the field can occur.

SUMMARY

Example embodiments provide an artificial turf mat of the above described type wherein the drawbacks do not occur. This is achieved according to example embodiments in that the mutual distance between successive blades in a row is substantially equal to the distance between adjacent rows which amounts to at least 10 mm.

The distance between the blades and the row spacing preferably amounts to at least 13 mm, and more preferably to at least 16 mm. Owing to such a large gap between the individual blades the filling material can be readily loosened periodically, whereby compression or compaction thereof is avoided. The risk of injury as a result of for instance studs getting caught in the artificial turf mat, or a relatively high rotational resistance thereof, is also reduced by this large interspacing.

The backing and the blades can be formed and mutually connected by weaving. This allows relatively larger distances between the blades and row spacing to be achieved than would be possible when tufting the blades to the backing.

The backing may comprise warp threads and weft threads woven therethrough, and the blades may be formed by pile threads arranged between the warp threads and parallel thereto.

In order to ensure an adequate connection of the blades to the backing despite the relatively large interspacing between the blades, each pile thread may be connected by weaving to a plurality of adjacent weft threads.

In order to provide sufficient artificial grass material at the relatively large mutual distances and row spacing that are considered here, the blades may be formed by threads having a density of at least 25,000 dtex, and preferably even a density of at least 30,000 dtex. The blades are thus formed from a relatively thick and/or heavy fiber material. By making use of a fiber material, for instance a yarn with a high yarn weight (Dtex number) or a large yarn volume, a well covered mat can be obtained which provides a natural (green) appearance. The farther apart the blades are, the greater the yarn weight and volume should be to ensure a sufficiently dense appearance and feel. For instance, while threads having a weight of 15,000 dtex could be used when the distance between the blades and the row spacing is around 10 mm, a yarn weight of 30,000 dtex would be more suitable when the blade distance and row spacing are increased to e.g. 15 mm.

The blades may be formed by threads which each include a plurality of fibers, for instance five or six fibers in each thread or yarn. In this way a more natural appearance is created than would be the case with relatively thick single blades. In one embodiment the fibers in each thread forming a blade have different densities and/or different cross-sectional shapes. This provides an even more natural appearance, and also allows the characteristics of the artificial grass blades to be tailored to specific applications of the mat.

The invention also relates to an artificial turf field formed by an artificial turf mat as described above and a layer of loose filling material arranged thereon, the thickness of which is less than the length of the artificial grass blades.

The invention further relates to a method for forming an artificial turf mat, comprising of supplying a backing material, supplying an artificial turf material, forming a backing from the backing material, and connecting blades of the artificial turf material divided into rows to the backing. Such a method is also generally known.

The method according to the present invention is distinguished from the known methods in that the blades are connected to the backing such that their mutual spacing in a row is substantially equal to the mutual distance between adjacent rows and amounts to at least 10 mm.

When the backing is formed by weaving the backing material, and the artificial turf material is co-woven to form the blades, relatively large mutual distances between the blades and relatively large row spacing may be obtained. Weaving also allows relatively thick yarn to be used for forming the artificial grass blades. The backing may be formed by weaving a plurality of weft threads through a plurality of warp threads, and the blades may be formed by pile threads arranged between the warp threads and parallel thereto.

Finally, the invention further relates to a method for forming an artificial turf field by arranging on a ground an artificial turf mat as described above and spreading thereover a layer of loose filling material to a thickness which is less than the length of the artificial grass blades.

BRIEF DESCRIPTION OF THE DRAWINGS

The invention is now elucidated on the basis of a number of embodiments, wherein reference is made to the annexed drawing, in which.

DETAILED DESCRIPTION OF EXAMPLE EMBODIMENTS

Figure 1:
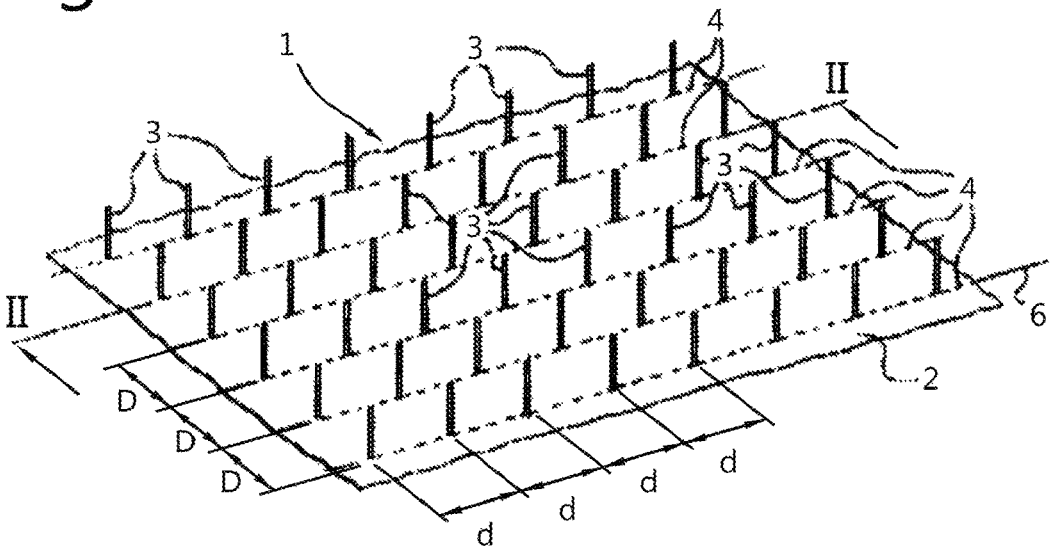
FIG. 1 shows a schematic perspective view of a part of an artificial turf mat according to a first example embodiment of the invention.

An artificial turf mat 1 (FIG. 1) includes a backing 2, for instance in the form of a woven fabric or non-woven, to which is attached a large number of protruding artificial grass blades 3. Blades 3 are distributed uniformly over rows 4 which are likewise uniformly distributed with an inter-spacing D. The mutual distance between blades 3 in a row 4 is designated with d. According to example embodiments, these distances are substantially corresponding so that D≈d. A uniform distribution of the artificial grass blades over mat 1 is hereby obtained, which results in homogeneous properties in all directions of a playing field based on this artificial turf mat 1.

Figure 3:
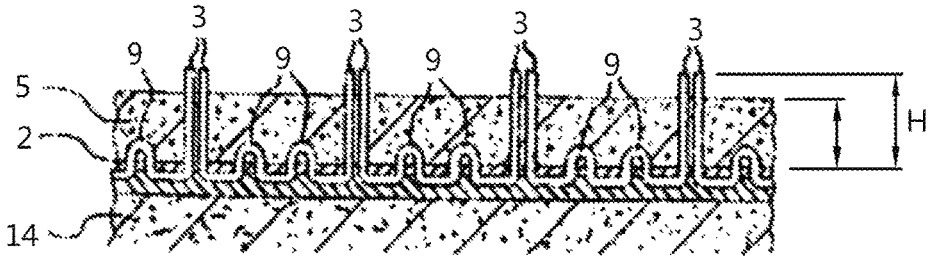
FIG. 3 is a cross-sectional view corresponding with FIG. 2 of an artificial turf field based on an alternative example embodiment of the artificial turf mat.

In order to avoid studs of sports footwear catching in the blades 3, and also to prevent a filling material 5 (FIG. 3) spread on artificial turf mat 1 being held too firmly in place, whereby this material would be compacted and hardened, the mutual distances d, D are chosen to be relatively large. According to example embodiments, these two distances amount to 10 mm or more, but more preferably to 13 mm or more, and most preferably to more than 16 mm.

Figure 2:
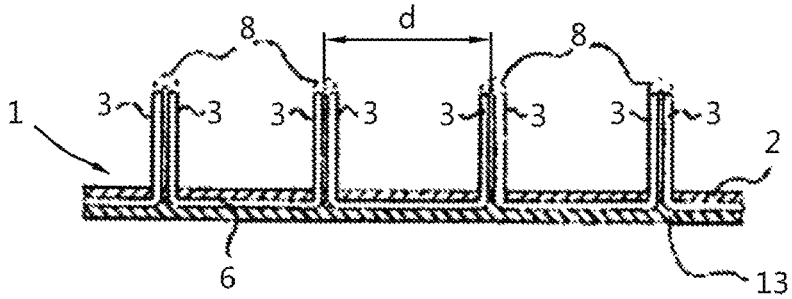
FIG. 2 shows a cross-section along line II-II in FIG. 1.
Figure 8:
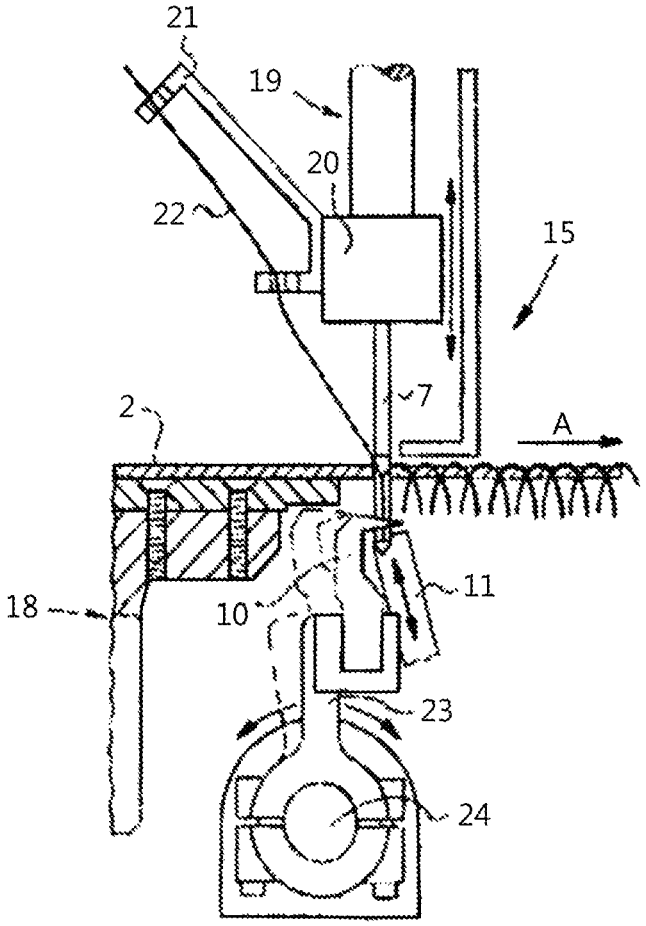
FIG. 8 is a schematic view of a tufting machine with which an artificial turf mat according to example embodiments can be manufactured.

In a first example embodiment, the artificial grass blades 3 are tufted into backing 2. Use is herein made for each row 4 of a continuous thread 6, here of monofilament fiber, which is pressed into backing 2 in a regular pattern by an up and downward moving tufting needle 7 (FIG. 8) and then held fast by looping hooks 10, with the formation of loops 8 (FIG. 2). During so-called cut pile tufting, these loops 8 are severed or cut by means of knives 11 co-acting with looping hooks 10, whereby two artificial grass blades 3 are formed in each case standing adjacently of each other.

Where mention is made in this text of the mutual distance d between adjacent blades, this does not therefore refer to the distance between blades 3 formed from a single loop 8, but to the distance between two loops 8 and the pairs of blades 3,3 formed therefrom.

Figure 4:
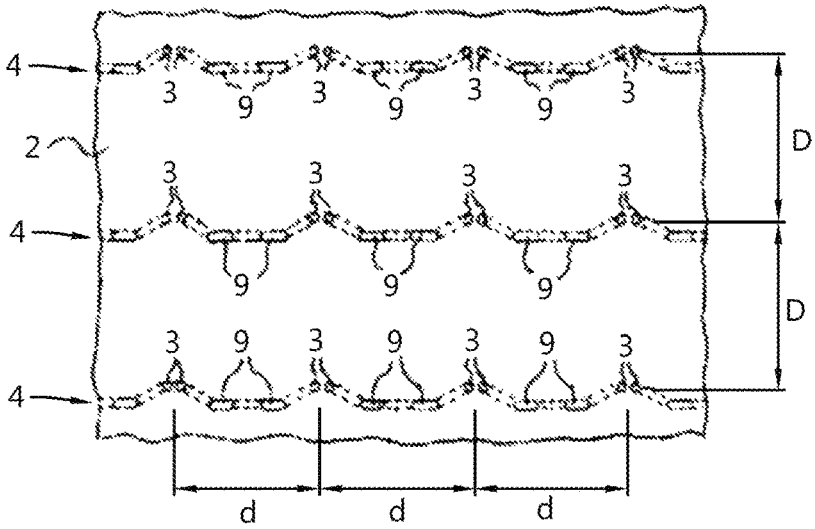
FIG. 4 is a top view of the artificial turf mat of FIG. 3.

In order to strengthen the connection between the continuous tuft thread 6 and backing 2, one or more further support loops 9 can be tufted between successive (pairs of) blades 3. These support loops 9 protrude less far through backing 2 than the loops 8 from which the blades 3 are formed, nor are they cut open. Use can be made to form these support loops of separate or secondary looping hooks, and so as to prevent conflicts between these secondary looping hooks and the looping hooks for forming of blades 3, the support loops 9 are preferably formed outside the row 4 (FIG. 4).

Blades 6 are otherwise fixed in the usual manner in the backing 2 after the tufting by providing the latter on the underside with an adhesive layer 13, which can be glued or welded to backing 2.

Figure 5:
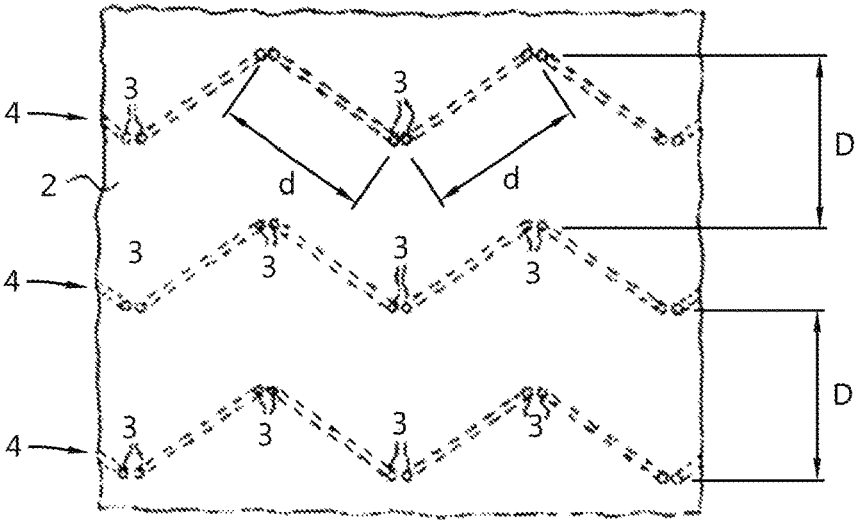
FIG. 5 is a top view of an artificial turf mat with an alternative orientation of the rows of artificial grass blades.

For application, it is not essential for the rows 4 to run straight. A different pattern, for instance with zigzag rows 4 (FIG. 5), can also be envisaged as long as the mutual distance between the different artificial grass blades (or pairs of blades) 3 is substantially equal, and greater than 10 mm. Other patterns may also be used.

For forming of the artificial turf field 12, the artificial turf mat 1 is laid on a flat, slightly resilient ground 14 (FIG. 3) and a layer of loose filling material 5, for instance, sand or a mixture of sand and rubber granules, is spread thereover. The thickness h of the layer of filling material 5 is chosen to be smaller than the height H of artificial grass blades 3, so that these latter protrude above filling material 5.

Figure 6:
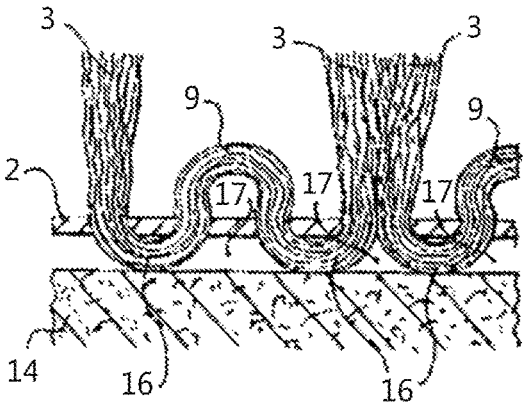
FIG. 6 is a cross-sectional view corresponding with FIGS. 2 and 3 of an artificial turf field with yet another embodiment of the artificial turf mat.

When blades 3 and support loops 9 are formed from a relatively thick fiber material or for instance a composite yarn bundle, the fiber or yarn segments 16 between blades 3 and support loops 9 protrude relatively far on the underside of backing 2, whereby intermediate spaces or air chambers 17 are as it were formed therebetween (FIG. 6). These intermediate spaces 17 contribute toward the shock absorption and energy restitution of artificial turf field 12, which is particularly important when it is laid on a relatively flat and hard ground.

The artificial turf mat 1 as shown here can be manufactured on a tufting machine 15 which is of conventional construction and forms no part of the invention. Tufting machine 15 is provided with a frame with a bed 18 and a head 19 arranged thereabove. Present on the infeed side of bed 18 is a feed roller (not shown) for the material of backing 2, while on an opposite side there is arranged a wind-up roller (not shown) for the tufted artificial turf mat 1, so that the material of the backing is transported over the bed in the direction of arrow A.

Situated in head 19 is an up and downward movable bar 20 in which is received a series of tufting needles 7. The mutual distance between tufting needles 7 herein defines the row distance D. Guides 21 are further fixed to needle bar 20 for carrying to the needles 7 the fiber material 22 from which the blades 3 are formed.

A number of looping hooks 10 corresponding with the number of tufting needles 7 are arranged in bed 18. These looping hooks 10 are fixed to arms 23 which are pivotable on a shaft 24, so that looping hooks 10 are movable roughly parallel to the backing material and thus roughly transversely of needles 7 to take over the loops placed through the backing material by needles 7. Adjacently of looping hooks 10 are further arranged the knives 11 co-acting therewith which cut open the loops to form said pairs of blades 3.

The wind-up roller, needle bar 20 and pivot shaft 24 are driven by (servo)motors (not shown) which are all connected to a control system. The insertion depth for instance of needles 7 can hereby be set, while by regulating the motors the insertion speed can be adapted to the winding-up speed such that between two successive insertion movements of needles 7 the material of backing 2 is moved forward each time through the distance d corresponding with the row distance D. In addition, it is possible to interrupt the winding-up each time the tufting needles 7 are inserted into backing 2.

Figure 7:
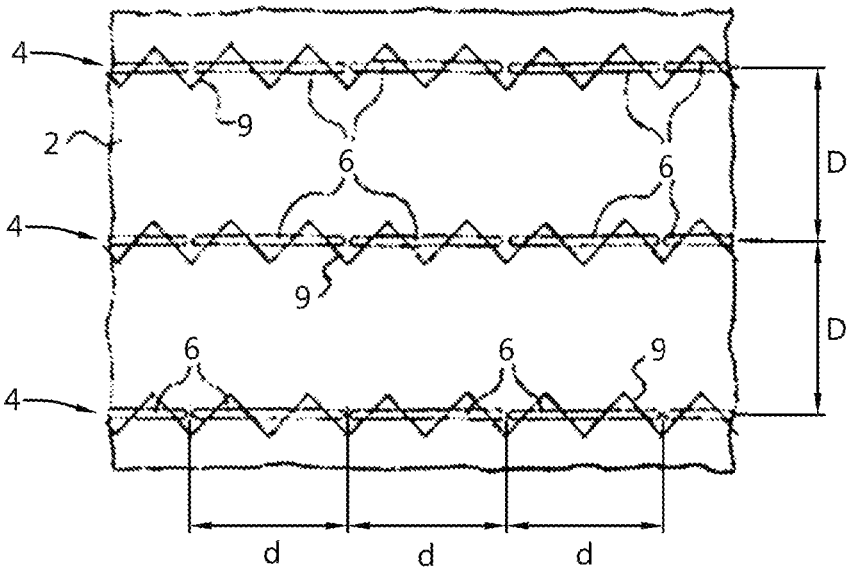
FIG. 7 is a bottom view of an artificial turf mat with separately formed blades and support loops.

Use could optionally be made for the tufting of a tufting machine with two needle bars movable independently of each other and looping hooks and knives co-acting with the bars, such as described for instance in GB-A-2 357 301. The support loops 9 could hereby be tufted independently of blades 3. For the support loops 9, which could optionally be arranged crosswise over fiber 6 between successive (pairs of) blades 3 (FIG. 7), use could then be made of another fiber material, for instance a much thinner yarn.

Figure 9:
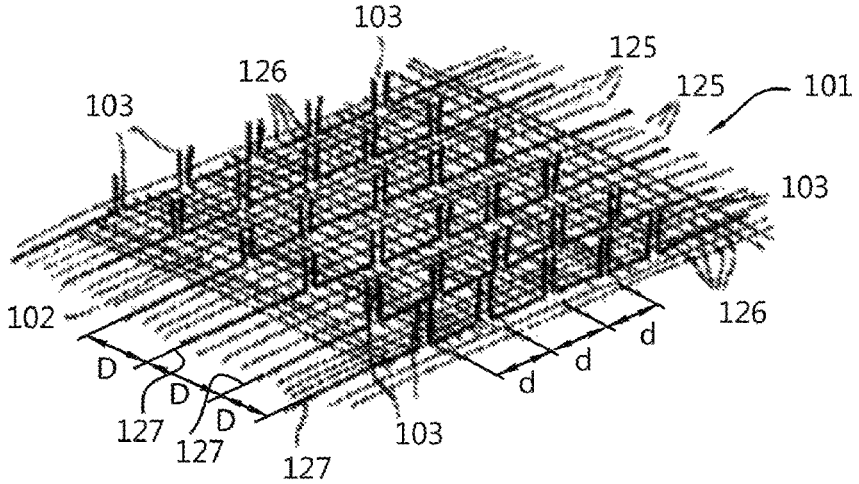
FIG. 9 is a schematic perspective view of an artificial turf mat in accordance with a example embodiment of the invention.
Figure 10:
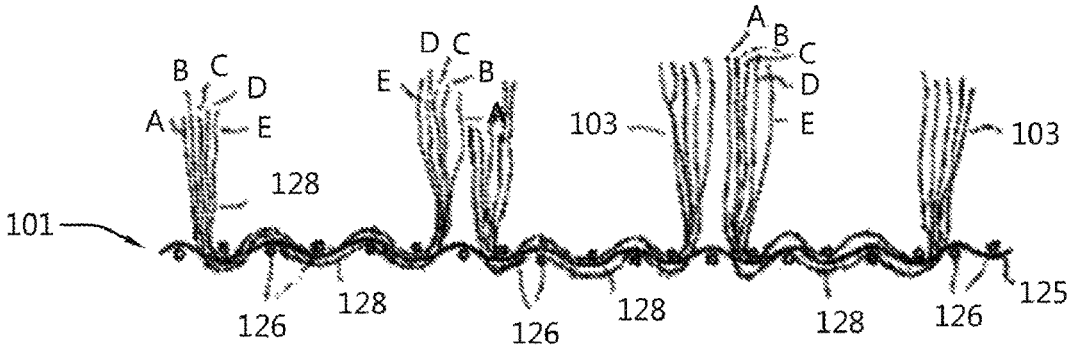
FIG. 10 shows a cross-section along line X-X in FIG. 9.

In another example embodiment, the backing 102 of the artificial turf mat 101 is woven and the artificial grass blades 103 are co-woven at the same time. The backing is made up of warp threads 125 and weft threads 126 that are woven through the warp threads 125 at right angels thereto (FIG. 9). The artificial grass blades 103 are formed by pile threads 127 which run parallel to the warp threads 125 and are spaced apart a distance D. In the illustrated example embodiment, each pile thread 127 is made up of a bundle of fibers 128, in this case five fibers 128A-E (FIG. 10). These five fibers 128A-E may have different characteristics and different colors—i.e. various shades of green—to give the look and 'feel' of natural grass. The characteristics of the fibers 128A-E may be varied by selecting fibers with different cross-sections, different densities and different stiffness.

A plurality of weft threads 126, in this case five weft threads, are woven through each pile thread 127 between the two protruding ends of the pile thread 127 which will form the artificial grass blades 103. In this way the blades 103 are securely connected to the backing 102. The protruding ends are formed by cutting the pile thread 127, which is continuously woven into the backing 102, at a desired location. Here again, the distanced between the protruding ends forming the grass blades 103 is substantially equal to the spacing D of the pile threads 127.

Since the spacing D and the blade distance d are selected such as to be relatively large—10 mm and more—the pile threads 127 must have a relatively large volume and weight to provide sufficient grass blades 103. For instance, when the spacing D and distance d are set at 10 mm, pile threads 127 having a density in the order of 12,000 dtex could be used. However, when the distance d and spacing D are increased to e.g. 13 mm, the number of grass blades 103 per unit area is reduced by 70 percent, and the density of the pile threads 127 should be at least 20,000 dtex to provide a similar amount of artificial grass material. Increasing the distance d and spacing D even further, e.g. to 16 mm, would lead to an even smaller number of grass blades 103, which should then have a correspondingly higher yarn weight in the order of 30,000 dtex. Yarn having such a high density cannot be processed on a conventional tufting machine, so that weaving is the preferred option.

An advantage of weaving is that the pile thread 127 lies substantially in the same plane as the backing 102, so that the underside of the backing 102 with the woven grass blades 103 is relatively flat. This results in an even playing field.

Although example embodiments of the invention are elucidated above with reference to an embodiment, it will be apparent that the invention is not limited thereto. Materials other than those discussed here are also conceivable. The artificial grass blades, or at least the outer ends thereof, could thus be fibrillated. It is also conceivable for the tufted loops not to be cut open, whereby double blades would in fact be formed. The composite yarn used when weaving the grass blades could include more or less fibers than shown and described here, and higher or lower values could be selected for the spacing D and distance d.

The scope of the invention is therefore defined solely by the now following claims.

The invention claimed is:

1. An artificial turf mat, comprising:

a backing; and a plurality of protruding artificial grass blades divided into rows and connected to the backing, wherein the backing and plurality of protruding artificial grass blades are formed and mutually connected by weaving, wherein the backing includes warp threads and weft threads woven therethrough, wherein the plurality of protruding artificial grass blades are formed by pile threads arranged between the warp threads and parallel thereto, wherein each pile thread is connected by weaving to a plurality of adjacent weft threads, wherein a mutual distance between successive blades in a row is substantially equal to the distance between adjacent rows and is at least 10 mm, and wherein a plurality of protruding artificial grass blades are formed by threads having a linear mass density of at least 12,000 dtex and selecting a relatively large volume and weight as a function of the mutual distance between successive blades in a row and the distance between adjacent rows, and matching the volume and weight and the mutual distance so as to provide an amount of artificial grass material in the order of at least approximately 120 million dtex per square meter.

2. The artificial turf mat as claimed in claim 1, wherein the distance between the plurality of protruding artificial grass blades and the row spacing is at least 13 mm, and wherein the plurality of protruding artificial grass blades are formed by threads having a linear mass density of at least 20,000 dtex.

3. The artificial turf mat as claimed in claim 2, wherein the distance between the plurality of protruding artificial grass blades and the row spacing is at least 16 mm, and wherein the plurality of protruding artificial grass blades are formed by threads having a density of at least 30,000 dtex.

4. The artificial turf mat as claimed in claim 1, wherein the plurality of protruding artificial grass blades are formed by threads which each include a plurality of fibers.

5. The artificial turf mat as claimed in claim 4, wherein the fibers in each thread forming a blade have different densities and/or different cross-sectional shapes.

6. An artificial turf field, comprising:

the artificial turf mat as claimed in claim 1, and a layer of loose filling material arranged thereon, the thickness of which is less than the length of the plurality of protruding artificial grass blades.

7. The artificial mat according to claim 1, wherein the woven plurality of weft threads are interwoven in a three adjacent yarn weave.

8. A method for forming an artificial turf mat, comprising:

supplying a backing material;

supplying an artificial turf material;

forming a backing from the backing material;

connecting blades of the artificial turf material divided into rows to the backing;

weaving the backing material to form the backing, and the artificial turf material is co-woven to form the blades;

connecting the blades of the artificial turf material to the backing such that a mutual spacing in a row is substantially equal to a mutual distance between adjacent rows and is at least 10 mm apart;

selecting a relatively large volume and weight to form the blades via the threads having a linear density of at least 12,000 dtex; and matching the volume and weight and the mutual distance so as to provide an amount of artificial grass material in the order of at least approximately 120 million dtex per square meter, wherein the backing is formed by weaving a plurality of weft threads through a plurality of warp threads woven, wherein the blades are formed by pile threads arranged between the warp threads and parallel thereto, and wherein the plurality of weft threads is woven through each pile thread.

9. The method as claimed in claim 8, wherein the blades are connected to the backing at a mutual distance and a row spacing of at least 13 mm, and wherein the blades are formed by threads having a density of at least 20,000 dtex.

10. The method as claimed in claim 9, wherein the blades are connected to the backing at a mutual distance and a row spacing of at least 16 mm, and wherein the blades are formed by threads having a density of at least 30,000 dtex.

11. The method as claimed in claim 8, wherein the blades are formed by threads which each include a plurality of fibers.

12. The method as claimed in claim 11, wherein the fibers in each thread forming a blade have different densities and/or different cross-sectional shapes.

13. The method for forming an artificial turf field by arranging on a ground an artificial turf mat as claimed in claim 1, and spreading thereover a layer of loose filling material to a thickness which is less than the length of the artificial grass blades.

14. An artificial turf mat, comprising:

a backing; and a plurality of protruding artificial grass blades divided into rows and connected to the backing, wherein the backing and the plurality of protruding artificial grass blades are formed and mutually connected by weaving, wherein the backing includes warp threads and weft threads woven therethrough, wherein the plurality of protruding artificial grass blades are formed by pile threads arranged between the warp threads and parallel thereto, wherein each pile thread is connected by weaving to a plurality of adjacent weft threads, wherein a mutual distance between successive blades in a row is substantially equal to the distance between adjacent rows, and wherein the plurality of protruding artificial grass blades are formed by pile threads, a volume and weight of which is selected as a function of the mutual distance between successive blades in a row and the distance between adjacent rows, and matching the volume and weight and the mutual distance so as to provide an amount of artificial grass material in the order of approximately 120 million dtex per square meter.

15. The artificial turf mat as claimed in claim 14, wherein the mutual distance between successive blades in a row and the distance between the adjacent rows is at least 10 mm and wherein the plurality of the protruding artificial grass blades are formed by pile threads having a linear mass density of at least 12,000 dtex.

16. The artificial turf mat as claimed in claim 15, wherein the mutual distance between successive blades in a row and the distance between the adjacent rows is at least 13 mm and wherein the plurality of the protruding artificial grass blades are formed by pile threads having a linear mass density of at least 20,000 dtex.

17. The artificial turf mat as claimed in claim 16, wherein the mutual distance between successive blades in a row and the distance between the adjacent rows is at least 16 mm and wherein the plurality of the protruding artificial grass blades are formed by pile threads having a linear mass density of at least 30,000 dtex.

18. A method for forming an artificial turf mat, comprising:

supplying a backing material;

supplying an artificial turf material;

forming a backing from the backing material; and connecting blades of the artificial turf material divided into rows to the backing;

weaving the backing material to form the backing, and the artificial turf material is co-woven to form the blades;

connecting the blades of the artificial turf material to the backing such that a mutual spacing in a row is substantially equal to a mutual distance between adjacent rows;

selecting the volume and weight to form the blades via pile threads as a function of the mutual distance between successive blades in a row and the mutual distance between adjacent rows; and matching the volume and weight and the mutual distance so as to provide an amount of artificial grass material in the order of approximately 120 million dtex per square meter, wherein the backing is formed by weaving a plurality of weft threads through a plurality of warp threads woven, wherein the blades are formed by pile threads arranged between the warp threads and parallel thereto, and wherein the plurality of weft threads is woven through each pile thread.

19. The method as claimed in claim 18, wherein the mutual distance between successive blades in a row and the distance between the adjacent rows is at least 10 mm and wherein the plurality of the protruding artificial grass blades are formed by pile threads having a linear mass density of at least 12,000 dtex.

20. The method as claimed in claim 18, wherein the mutual distance between successive blades in a row and the distance between the adjacent rows is at least 13 mm and wherein the plurality of the protruding artificial grass blades are formed by pile threads having a linear mass density of at least 20,000 dtex.

21. The method as claimed in claim 19, wherein the mutual distance between successive blades in a row and the distance between the adjacent rows is at least 16 mm and wherein the plurality of the protruding artificial grass blades are formed by pile threads having a linear mass density of at least 30,000 dtex.

* * * * *